US005174017A

United States Patent [19]

Hatagishi

[11] Patent Number: 5,174,017

[45] Date of Patent: Dec. 29, 1992

[54] PULL TAB LOADING APPARATUS OF SLIDE FASTENER SLIDER ASSEMBLING MACHINE

[75] Inventor: Shingo Hatagishi, Toyama, Japan

[73] Assignee: Yoshida Kogyo K. K., Tokyo, Japan

[21] Appl. No.: 859,340

[22] Filed: Mar. 30, 1992

[30] Foreign Application Priority Data

Mar. 28, 1991 [JP] Japan ..... 3-089544

[51] Int. Cl.[5] ..... A41H 37/06

[52] U.S. Cl. ..... 29/766; 29/409

[58] Field of Search ..... 29/408, 409, 766, 33.2

[56] References Cited

U.S. PATENT DOCUMENTS

| | | | |
|---|---|---|---|
| 2,354,690 | 8/1944 | Lawson | 29/409 |
| 2,825,126 | 3/1958 | Legat et al. | 29/766 |
| 3,138,852 | 6/1964 | Mazura | 29/766 |
| 5,025,544 | 6/1991 | Yoneda et al. | 29/766 |
| 5,067,221 | 11/1991 | Oyama | 29/766 |

*Primary Examiner*—P. W. Echols

[57] ABSTRACT

A pull tab loading apparatus comprising a straight inclined chute for receiving pull tabs lined up in a row, and a pull tab pushing unit for successively pushing pull tabs from a downstream end of the chute to a pull tab inlet port of a slide fastener slider assembling machine. A contact pin is rotatably supported by the pushing unit for engagement with an upper surface of the pull tab being fed from the downstream end of the chute into a guide groove of the pushing unit in an inclined posture.

3 Claims, 6 Drawing Sheets

PULL TAB LOADING APPARATUS OF SLIDE FASTENER SLIDER ASSEMBLING MACHINE

BACKGROUND OF THE INVENTION

1. Field of the Invention

This invention relates to an improved automatic apparatus for supplying pull tabs successively to a pull tab inlet port of a machine for automatically assembling slide fastener sliders.

2. Description of the Related Art

An apparatus for supplying pull tabs to an automatic slide fastener slider assembling machine is disclosed in, for example, U.S. Pat. No. 3,138,852.

In the apparatus of this U.S. Patent, as shown in FIGS. 20 through 23 of the Patent, a pull tab chute is arcuately curved, and a claw is pivotally and vertically movable to feed out a pull tab at a time from the downstream end of the chute. With this relatively complex arrangement, it is impossible to feed out a flat rectangular pull tab smoothly and accurately so that high-speed assembling operation cannot be achieved.

In a pull tab loading apparatus disclosed in U.S. Pat. No. 2,825,126, as shown in FIGS. 21 and 22 of the Patent, a pull tab chute is curved so as to receive pull tabs stacked one over another, each in a horizontal posture. A lowest pull tab is pushed out aside by a pusher. According to this prior art, it is impossible to supply pull tabs smoothly so that high-speed assembling operation is difficult to achieve.

A straight chute is disclosed in, for example, Japanese Patent Publication No. 41243/1982. With this straight chute, although it is possible to feed flat rectangular pull tabs smoothly, a lowest pull tab is fed out by a complex means so that high-speed assembling operation is difficult to achieve.

Japanese Patent Publication No. 25563/1986 discloses another pull tab loading apparatus equipped with a straight chute. In this prior art, a pull tab locked at the downstream end of the chute is inserted directly into a pull tab attachment hook on a slider body whereupon the hook is caulked to complete a slider, and there are provided at the downstream end of the chute a valve for discharging a completed slider and a lock detector for activating the valve. In the chute at a position above the downstream end, a stop is provided for temporarily locking the pull tab. Thus this prior apparatus is complex in structure and is not suitable for use in high-speed assembling operation.

SUMMARY OF THE INVENTION

It is therefore a pull tab loading apparatus which is simple in structure and by which flat rectangular pull tabs can be supplied to a slide fastener slider assembling machine smoothly and accurately even during high-speed assembling operation.

According to this invention, there is provided a pull tab loading apparatus in a slide fastener slider assembling machine, comprising: a pull tab chute sloping from an upstream end to a downstream end and having a chute groove for receiving pull tabs as longitudinally lined up in a row; a pull tab pushing unit having in a base a horizontally extending pull tab guide groove which faces at one end of an inlet port of the slider assembling machine and communicates with the chute groove at a downstream end thereof, the guide groove having a center line in a vertical plane in which a center line of the chute groove exists, the pushing unit including a pull tab pusher slidably received in the guide groove for reciprocating movement between the downstream end of the chute groove and the inlet port of the slider assembling machine so as to successively move the pull tabs, one by each forward stroke, into the inlet port of the slider assembling machine; and a contact pin rotatably located upwardly of the base adjacently to the downstream end of the chute groove of the chute for engagement with an upper surface of the pull tab being fed from the downstream end of the chute groove to the guide groove in an inclined posture. The contact pin is supported by a U-shaped groove of the base of the pushing unit and is normally urged downwardly.

With this arrangement, since the chute groove of the chute can receive flat rectangular pull tabs as longitudinally lined up in a row, a group of pull tabs following a leading pull tab can be moved smoothly toward the downstream end of the chute along the chute groove by gravity after the leading pull tab has been discharged.

Since the downstream end of the chute groove communicates with the guide groove in the base of the pushing unit, a leading pull tab in the chute groove slides down to reach the guide groove to assume an inclined posture as extending between the two grooves.

At that time, the contact pin supported by the base is in contact with the upper surface of the inclined pull tab. Assuming that a preceding pull tab lies flat in the guide groove, the inclined pull tab rests on the upper surface of the preceding pull tab and is then prevented from sliding down any further.

Then when the pusher is moved forwardly, the pull tab lying flat in the guide groove is pushed into the inlet port of the slider assembling machine.

In response to the forward stroke of the pusher, the upper surface of the pusher frictionally passes under the lower end edge of the inclined pull tab, bringing the pull tab forwardly until the same pull tab comes off the chute groove and then rides on the pusher. At that time the contact pin rotates so that the pull tab can be changed in posture smoothly.

When the pusher is moved backwardly, the upper surface of the pusher is in contact with the lower end edge of the leading pull tab, but the pull tab receives a pressure by a group of pull tabs succeeding the leading pull tab. Therefore the leading pull tab slides down to lie flat in the guide groove at the end of backward stroke of the pusher, without following the backward movement of the pusher.

A pull tab succeeding the pull tab slid down into the guide groove slides down from the chute groove into the guide groove to rest on the upper surface of the preceding pull tab lying flat in the guide groove, extending between the two grooves in contact with the contact pin.

Then the pusher is moved forwardly again to repeat the foregoing loading action.

In the apparatus of this invention, partly since the pull tab slide down from the chute groove to the guide groove by gravity and is held in an inclined posture by the rotatable contact pin, and partly since the pull tabs are fed one after another into the inlet port of the slider assembling machine in a relatively simple action, i.e. by reciprocating motion of the pusher, it is possible to cope with high-speed assembling operation.

DETAILED DESCRIPTION

Figure 1:
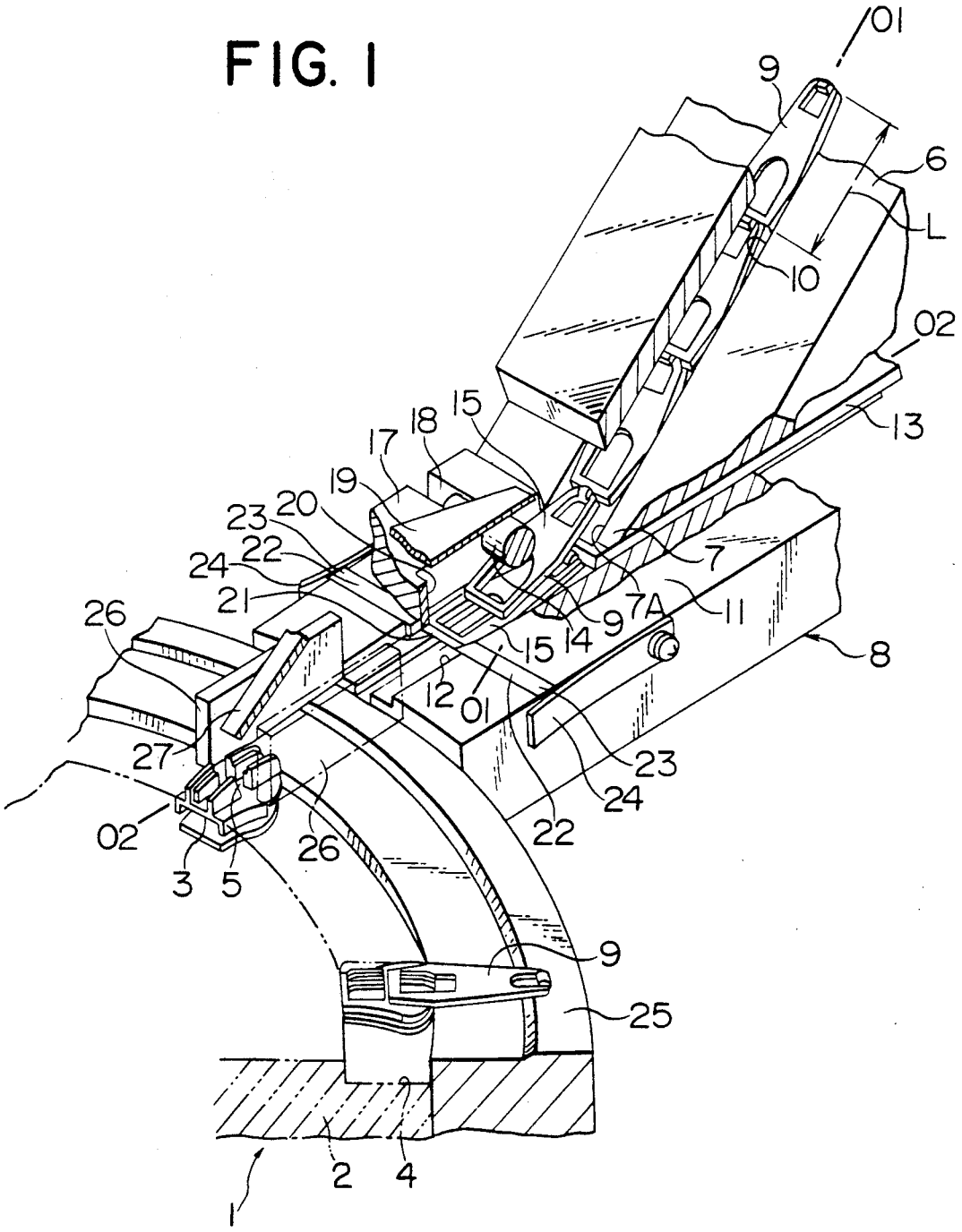
FIG. 1 is a perspective view, partially in cross section, of a pull tab loading apparatus according to a first embodiment of this invention.

FIGS. 1 through 6 show a pull tab loading apparatus, in a slide fastener slider assembling machine 1, according to a first embodiment of this invention. The slider assembling machine 1 is equipped with an intermittently rotating disk 2 having a plurality of recesses 4 formed in its peripheral portion at regular distances for receiving slider bodies 3. During a complete rotation of the disk 2, successive slide fastener sliders are progressively assembled in a series of various processing steps.

Outside a pair of side guide plate 26, 26 provided over an annular guide 25 of the slider assembling machine 1, there are located a pull tab chute 6 and a pull tab pushing unit 8 connecting a downstream end 7 of the chute 6 with the inlet port 5.

The chute 6 has a chute groove 10 for receiving pull tabs 9 lined up lengthwise in a row, sloping from a non-illustrated upstream end to a downstream end 7 so that the pull tabs 9 can slide down in order by gravity. L stands for the length of an individual pull tab 9.

The pushing unit 8 has in a base 11 a horizontally extending pull tab guide groove 12 which faces, at one end, the side guide plate 26, 26 of the slider assembling machine 1 and communicates with the chute groove 10 at the downstream end 7A thereof, the guide groove 12 having a center line 02—02 in a vertical plane in which a center line 01—01 of the chute groove 10 exists. The pushing unit 8 includes a pull tab pusher 13 slidably received in the guide groove 12.

The pull tab pusher 13 is operatively connected with a non-illustrated reciprocating drive unit, such as a fluid pressure means or a mechanical link means, and is thereby reciprocatingly movable between the junction of the chute groove 10 and the guide groove 12 and the inlet port 5 of the slider body 3. The length of stroke of the pull tab pusher 13 is such that a pull tab 9 transferred from the chute groove 10 to the guide groove 12 can be moved into the inlet port 5 of the slider body 3.

On the base 11 of the pushing unit 8, a contact pin 14 is rotatably mounted adjacently to the downstream end 7A of the chute groove 10 of the chute 6. The contact pin 14 is engageable with an upper surface 15 of the pull tab 9 being fed from the downstream end 7A of the chute groove 10 to the guide groove 12 in an inclined posture.

Figure 2:
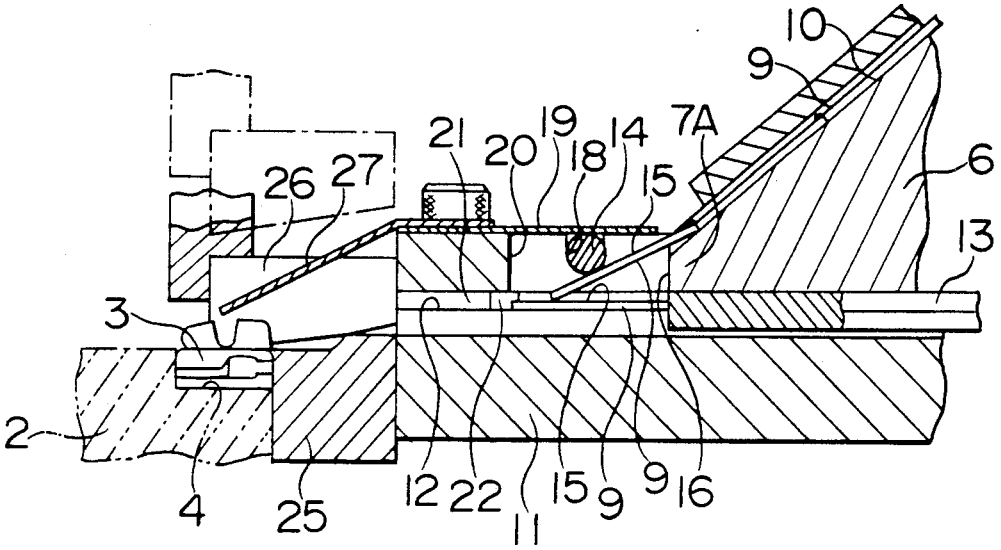
FIG. 2 is a fragmental vertical cross-sectional view of the apparatus of FIG. 1, showing a pull tab pusher before being moved forwardly.
Figure 3:
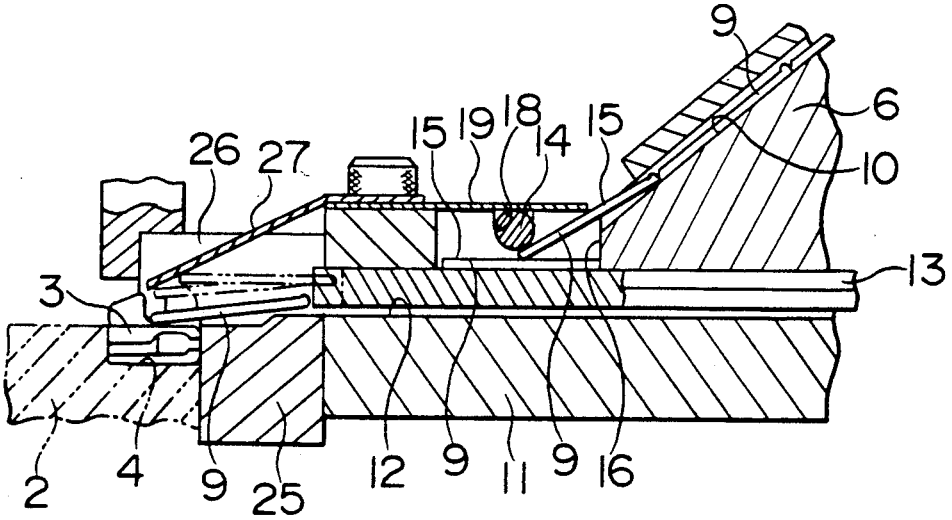
FIG. 3 is a view similar to FIG. 2, showing the pull tab pusher being moved forwardly.

In this embodiment, as shown in FIGS. 2 and 3, there is a difference 16 in level between the downstream end 7A of the chute groove of the chute 6 and the guide groove 12 of the base 11 so that the pull tab 9 can change the inclined posture to the horizontal posture in a short distance of travelling.

The contact pin 14 is rotatably and vertically slidably supported at opposite ends in a pair of U-shaped grooves 18, 18 formed in opposite side walls 17, 17 of the base 11 and is normally urged downwardly by a leaf spring 19. During its transfer, the pull tab 9 raises the contact pin 14 against the bias of the leaf spring 19.

In the illustrated embodiment, the pull tab pusher 13 has a T-shaped transverse cross section, and the guide groove 12 has a transverse cross-sectional shape substantially complementary to the transverse cross-sectional shape of the pull tab pusher 13 for receiving the pull tab pusher 13. This invention should by no means be limited to this specific form.

At a position toward the slider assembling machine 1, there is provided a restricting plate 20 extending transversely over the guide groove 12 for restricting the forward movement of the pull tab 9 transferred from the chute groove 10 to the guide groove 12, namely, for restricting the position at which a succeeding pull tab 9 resting on the pull tab pusher 13 is to be stopped while the preceding pull tab 9 lying flat in the guide groove 12 is moved forwardly by the pull tab pusher 13. Between the lower edge of the restricting plate 20 and the bottom of the guide groove 12, there is defined a passageway 21 such that only a single pull tab 9 can pass.

In the passageway 21, there is a pair of clamping members 22, 22 for clamping the pull tab 9 lying flat in the guide groove 12.

The clamping members 22, 22 are normally urged toward each other by a pair of leaf springs 24, 24 acting on their outside ends 23, 23. When a succeeding pull tab 9 slid down from the chute groove 10 comes into contact with the upper surface 15 of the preceding pull tab 9 lying flat in the guide groove 12, this preceding pull tab 9 is prevented from being displaced forwardly. The magnitude of resilience of the leaf springs 24, 24 are such that at the forward stroke of the pull tab pusher 13 these leaf springs 24, 24 are bent to allow the pull tab 9 to pass.

The slider assembling machine 1 has the annular guide 25 around the disk. A pair of side guide plates 26, 26 defines a pull tab guide path extending over the annular guide 25 from the forward end of the guide groove 12 to the inlet port 5 of the slider body 3. The side guide plates 26, 26 are operatively connected with a non-illustrated drive unit for vertical movement between the solid-line position and the dash-and-dot-line position in FIG. 2.

The side guide plates 26, 26 are lowered when the disk 2 is stopped and are raised after the pull tab 9 is introduced into the inlet port 5 and before the disk 2 starts rotating for the next process, thus being prevented from any interference with the disk in rotation.

An upper guide plate 27 is located between the side guide plates 26, 26, sloping from a position above the forward end of the guide groove 12 toward the inlet port 5. With this upper guide plate 27, it is possible to place the pull tab 9, which is pushed from the guide groove 12 by the pull tab pusher 13, on a pull tab attachment portion of a slider body 3 accurately and smoothly.

In this illustrated embodiment, the slider assembling machine 1 is a rotary type. Alternatively the slider assembling machine may be a stationary type in which assembling processes take place in a fixed position, and in such event, the guide plates 26, 26 are fixed.

Figure 5:
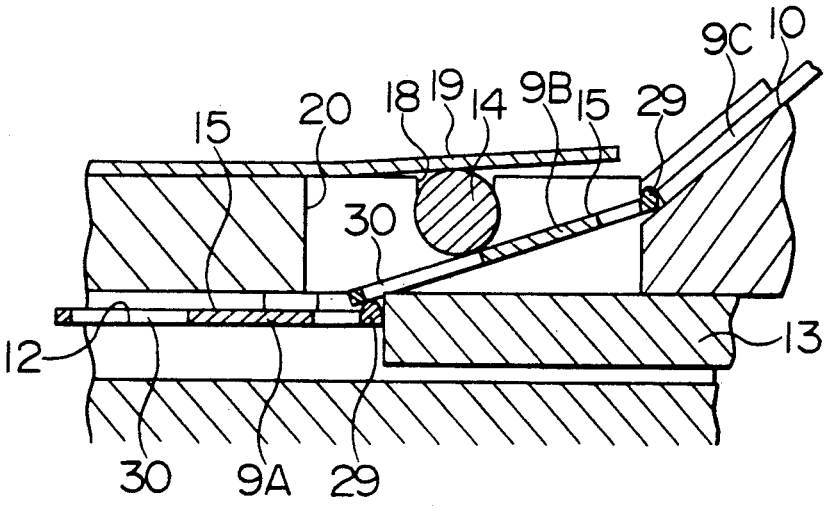
FIG. 5 is a view similar to FIG. 4, showing the pull tab pusher at the middle stage of its forward stroke.
Figure 6:
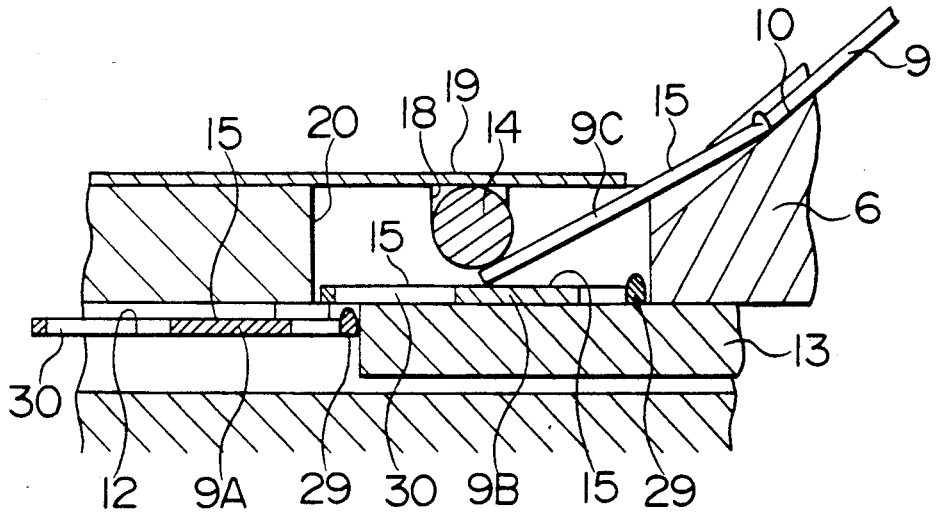
FIG. 6 is a view similar to FIG. 4, showing the pull tab pusher at the end stage of its forward stroke.
Figure 7:
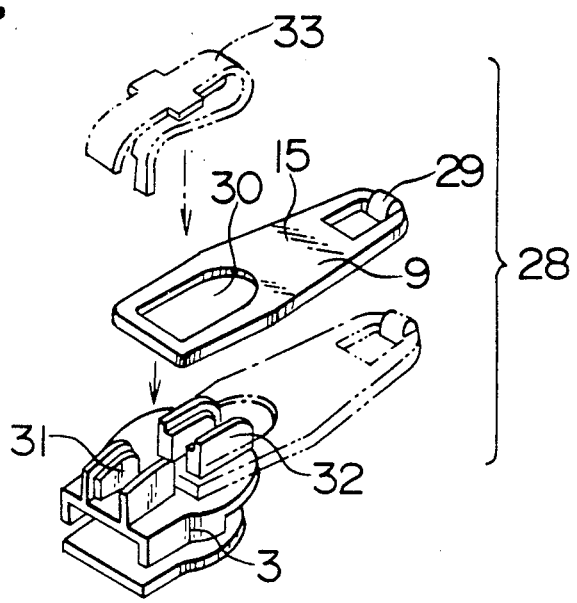
FIG. 7 is an exploded perspective view of a typical slider for which a pull tab has been supplied according to the first embodiment of FIG. 1.
Figure 8:
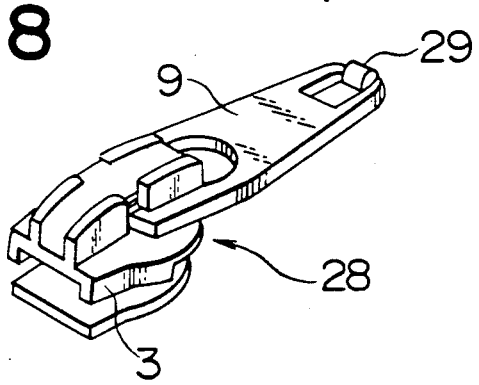
FIG. 8 is a perspective view of the slider of FIG. 7 after having been assembled.
Figure 9:
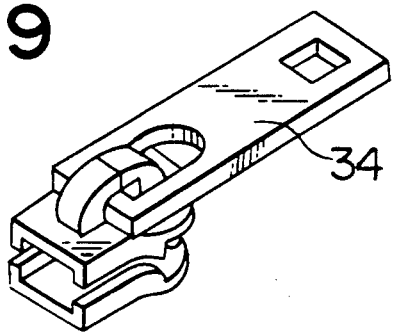
FIG. 9 is a perspective view similar to FIG. 8, showing an assembled slider of the type having no lock member.

FIGS. 7 and 8 show an automatic lock slider 28 which is assembled as a pull tab 9 is supplied by the apparatus of FIGS. 1 through 6. The pull tab 9 has at a free end a projection 29 and is loaded on a slider body 3 in such a manner that an attachment hole 30 is threaded on one of attachment lugs 31, 32 of the slider body 3. Then a lock member 33 is supplied at a downstream position of rotation of the disk 2, whereupon the attachment lugs 31, 32 are at upper ends clenched to complete the slider 28. Alternatively the slider may be a different type slider having no lock member, as shown in FIG. 9.

Since the pull tab 9 of the slider 28 of FIGS. 7 and 8 has at its free end the projection 29, the projection 29 of a preceding pull tab 9 presses the lower surface of a succeeding pull tab 9 when the preceding pull tab 9 lying flat in the guide groove 12 is moved forwardly by the pull tab pusher 13. This pressure is absorbed and canceled as the contact pin 14 is moved upwardly against the bias of the leaf spring 19, so that the pull tab 9 will not be prevented from moving from the chute groove 10 to the guide groove 12.

Figure 4:
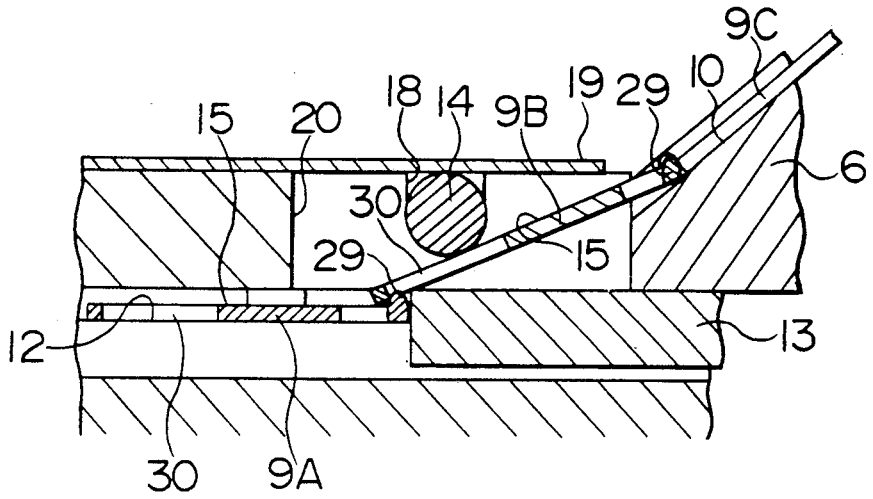
FIG. 4 is a fragmentary, enlarged vertical cross-sectional view of the apparatus of FIG. 2, showing the pull tab pusher at the initial stage of its forward stroke.

Assume that the projection 29 of a pull tab 9 can be inserted in the attachment hole 30 of another pull tab 9. When the pull tab 9A lying flat in the guide groove 12, with the projection 29 facing upwardly, is moved forwardly by the pull tab pusher 13, the projection 29 of the pull tab 9A comes into engagement with the attachment hole 30 of the succeeding pull tab 9B which assumes in an inclined posture extending between the downstream end 7A of the chute groove 10 and contacting both the upper surface 15 of the preceding pull tab 9A and the contact pin 14, as shown in FIG. 4.

With continued forward movement of the pull tab pusher 13, as shown in FIG. 5, the succeeding pull tab 9B changes its posture as progressively pushed upwardly. At that time, the contact pin 14 is raised against the bias of the leaf spring 19 to allow the pull tab 9B to move upwardly. Since the leaf spring 19 acts on the succeeding pull tab 9B to normally urge it downwardly, the succeeding pull tab 9B will assume a horizontal posture lying flat on the upper surface of the pull tab pusher 13 upon disengagement of the projection 29 of the preceding pull tab 9A from the attachment hole 30 of the succeeding pull tab 9B, as shown in FIG. 6.

In FIG. 6, the position of the succeeding pull tab 9B assuming a horizontal posture is restricted by the restricting plate 20 and the step portion 16 of the downstream end 7A of the chute groove 10. When the pull tab 9B assumes a horizontal posture, the next pull tab 9C slides down from the downstream end 7A of the chute groove 10 to assume an inclined posture, as shown in FIG. 6.

Figure 10:
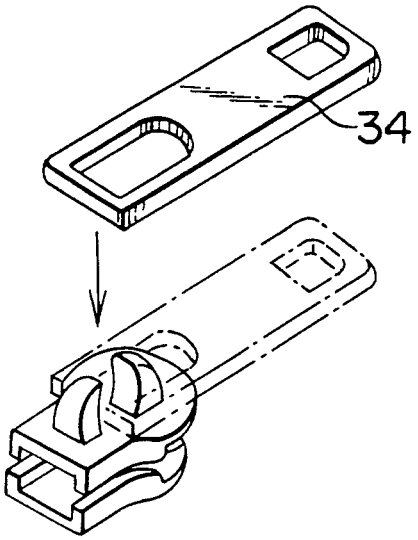
FIG. 10 is an exploded perspective view of the slider of FIG. 9 for which a pull tab has been supplied by a modified apparatus according to a second embodiment.
Figure 11:
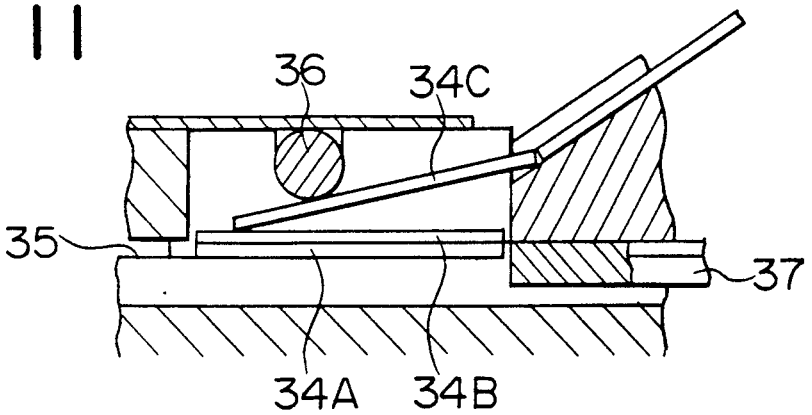
FIG. 11 is a fragmentary, enlarged vertical cross-sectional view of the apparatus of the second embodiment, showing a pull tab pusher before being moved forwardly.
Figure 12:
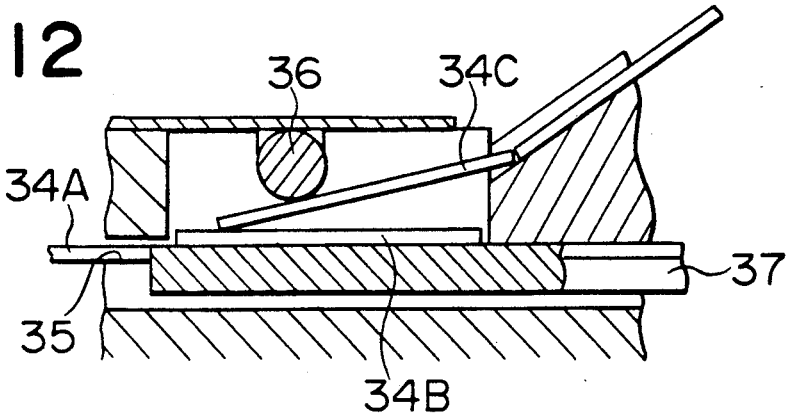
FIG. 12 is a view similar to FIG. 11, showing the pull tab pusher at the end stage of its forward stroke.

FIGS. 9 and 10 show a different type of pull tab 34 which is planar and has no projection. FIGS. 11 and 12 shows a second embodiment which is suitable to this type; the distance between a guide groove 35 and a contact pin 36 is large, compared to that in the first embodiment, so that a plurality of pull tabs 34A, 34B can lie flat in the guide groove 35. Only the lowest pull tab 34A is pushed forwardly by a pull tab pusher 37. The construction and operation of each part or element are identical with those of the first embodiment shown in FIGS. 1 through 6.

Since the chute receives pull tabs longitudinally lined up in a row and has a chute groove sloping from the upstream end to the downstream end, the pull tabs can slide down smoothly by gravity, thus guaranteeing high-speed pull tab loading.

Since a pull tab lying flat in the guide groove of the base of the pushing unit can be pushed into the inlet port of the slider assembling machine as the pull tab pusher reciprocatingly moves in the guide groove, the construction and operation of the pushing unit is relatively simple to cope with high-speed assembling.

A pull tab sliding down from the inclined chute groove to the horizontal guide groove comes into contact with the upper surface of a preceding pull tab lying flat in the guide groove, the contact pin, and the downstream end of the chute groove. The pull tab is thus temporarily held in an inclined posture and then changes this inclined posture to a horizontal posture in response to the forward movement of the preceding pull tab. At that time, since the contact pin rotates, it is possible to cause the pull tabs one after another to lie flat in the guide groove accurately at high speed, without causing any jamming due to simultaneous sliding of the pull tabs.

Since the contact pin can rotate and can move upwardly against the bias of the leaf spring, it is possible to absorb and cancel any impact and frictional resistance when the individual pull tab slides down from the chute groove and also when a preceding pull tab is pushed forwardly by the pull tab pusher, thus realizing a smooth and high-speed pull tab loading operation.

What is claimed is:

1. A pull tab loading apparatus in a slide fastener slider assembling machine, comprising:

(a) a pull tab chute sloping from an upstream end to a downstream end and having a chute groove for receiving pull tabs longitudinally lined up in a row;

(b) a pull tab pushing unit having in a base a horizontally extending pull tab guide groove which faces at one end of a pair of side guide plate of the slider assembling machine and communicates with said chute groove at a downstream end thereof, said guide groove having a center line in a vertical plane in which a center line of said chute groove exists, said pushing unit including a pull tab pusher slidably received in said guide groove for reciprocating movement between said downstream end of said chute groove and the inlet port of the slider assembling machine so as to successively move the pull tabs, one by each forward stroke, into the inlet port of the slider assembling machine; and (c) a contact pin rotatably located upwardly of said base adjacently to said downstream end of said chute groove of said chute for engagement with an upper surface of the pull tab being fed from said downstream end of said chute groove to said guide groove in an inclined posture.

2. A pull tab loading apparatus according to claim 1, wherein said contact pin is supported by a U-shaped groove of said base of said pushing unit and is normally urged downwardly.

3. A pull tab loading apparatus according to claim 1, wherein said pull tab has at a free end a projection and is loaded on a slider body in such a manner that an attachment hole is threaded on one of attachment lugs of the slider body.

* * * * *